US005181611A

United States Patent [19]

Liebel

[11] Patent Number: 5,181,611

[45] Date of Patent: Jan. 26, 1993

[54] CORNER POST HAVING LAMINATED PAPERBOARD SPINE

[76] Inventor: Henry L. Liebel, 10 Tower Dr., Newport, Ky. 41071

[21] Appl. No.: 808,376

[22] Filed: Dec. 16, 1991

[51] Int. Cl.[5] ..... B65D 85/48

[52] U.S. Cl. ..... 206/453; 206/586; 229/DIG. 1

[58] Field of Search ..... 206/453, 586, 813, 320, 206/326; 220/448; 229/DIG. 1

[56] References Cited

U.S. PATENT DOCUMENTS

| | | | |
|---|---|---|---|
| 2,068,771 | 1/1937 | Sherman . | |
| 2,160,221 | 5/1939 | Masters et al. . | |
| 2,196,157 | 4/1940 | White . | |
| 2,514,833 | 7/1950 | Bergeron . | |
| 2,526,052 | 10/1950 | Stimmel | 206/453 X |
| 2,950,038 | 8/1960 | Rupp | 206/586 X |
| 3,072,313 | 1/1963 | Svendsen . | |
| 3,133,687 | 5/1964 | Fremion . | |
| 3,337,111 | 8/1967 | Petriekis et al. . | |
| 3,433,354 | 3/1969 | Liebel . | |
| 3,536,245 | 10/1970 | Palmer . | |
| 3,556,529 | 1/1971 | Noriega . | |
| 3,708,101 | 1/1973 | McDanield . | |
| 3,734,389 | 5/1973 | Brown . | |
| 3,955,677 | 5/1976 | Collingwood . | |
| 3,973,720 | 8/1976 | Schmid . | |
| 4,120,441 | 10/1978 | Hurley . | |
| 4,714,163 | 12/1987 | Reeves | 206/586 X |
| 4,771,893 | 9/1988 | Liebel . | |
| 4,865,201 | 9/1989 | Liebel . | |
| 4,877,673 | 10/1989 | Eckel et al. . | |
| 4,883,179 | 11/1989 | Dionne . | |
| 4,938,360 | 7/1990 | Wallace . | |
| 5,048,689 | 9/1991 | McFarland | 206/586 |
| 5,131,541 | 7/1992 | Liebel | 206/453 |

FOREIGN PATENT DOCUMENTS 2080767 2/1962 United Kingdom .

*Primary Examiner*—Bryon P. Gehman

*Attorney, Agent, or Firm*—Wood, Herron & Evans

[57] ABSTRACT

An improved corner post including a right angle paper member having a pair of right angle legs joined at an apex and a hard, dense right angle paper spine adhered to the apex of the paper member and including an adhesive such as a hot melt extending along the apex between the spine and the apex.

6 Claims, 2 Drawing Sheets

CORNER POST HAVING LAMINATED PAPERBOARD SPINE

BACKGROUND OF THE INVENTION

This invention relates to corner posts used in the packaging of articles and, more particularly, to corner posts applied, for example, as vertical corner posts such as for application to the corners of a straight-sided article or container adapted for cushioning the straight corners and edges of packaged articles along the full height thereof and also adapted to permit the stacking of the packaged articles on each other without damaging the container or the article, and horizontal corner posts permitting pick up and movement of packaged articles by a squeeze truck without sideways crushing of the articles.

In packaging a number of articles including heavy articles such as refrigerators, television sets, stoves, air conditioners, and washing machines and dryers, it is customary to package them in relatively lightweight containers formed of paperboard or corrugated. The article is located and cushioned within the container by corner posts which typically are one or more pieces of cardboard folded to a 90° angle and inserted along the edges of the articles and the corners of the container. Such corner posts are used to provide cushioning to protect the corners of the packed article from damage such as scratching and denting during shipping and handling. A series of relatively narrow straps are typically wrapped around the container to secure the container and corner posts. These straps which may be a metal such as steel or a high strength plastic are tensioned to secure the package and absent corner posts would bite into the edges of the corrugated packaging and the article contained therein. Further, it is customary to package articles by enveloping them in a plastic film such as by shrink or stretch wrap techniques. Again, the edges of the article are cushioned and protected by corner posts extending along the length thereof secured inside the plastic film.

A number of corner posts are known to the art. Representative of such designs are U.S. Pat. Nos. 2,068,771; 2,160,221; 2,196,157; 2,514,833; 3,556,529; 3,133,687; 3,337,111; 3,536,245; 3,072,313; 3,433,354; 3,708,101; 3,734,389; 4,120,441; and G.B. 2,080,767. These prior art corner posts, however, all have one or more of the following disadvantages. Although some provide relatively good cushioning, they do not provide a load bearing capacity in the vertical direction which would permit the vertical stacking of loaded containers or, if they do, they are of substantial bulk and thus require large amounts of materials, are heavy, and take up space. For protectors not providing vertical load bearing capacity, when stacking of such containers is attempted, the weight of the upper container crushes the underlying containers by bending or buckling the walls of the container which bear the stacking load. Others which attempt to provide such vertical load bearing capacity in turn do not always provide sufficient cushioning and/or are relatively complex in design and expensive to manufacture. Since the packaging materials do not add value to the product itself, the cost of such materials are an important consideration to the manufacturer who uses such posts in shipping finished goods. Finally, some designs are subject to crushing by lateral forces supplied to the container and by shifting movement of the articles within the container detracting from the cushioning protection for the edges and corners of the article.

In my U.S. Pat. No. 4,771,893, I provide an integral, elongated corner post for cushioning and protecting the edges of a packaged article which provides excellent vertical load bearing or stacking strength and excellent horizontal load bearing strength as the case may be, good cushioning, good impact resistance, substantial thickness for spacing the outer surface of the packaged article from the side walls of the container or film but with a minimum of material, and which is lightweight, clean with no rough edges and simple in design and relatively economical to produce.

In my U.S. Pat. No. 4,865,201, I provide a combination laminated corrugated paper corner post which has improved shock resistance, increased columnar and beam strength, and a better ratio of strength to unit weight.

Also known to the art is a corner posts comprised of multiple layers of elongated paperboard which are laminated together, glued, treated, and formed into rigid right angles. The thickness of the corner post is determined by the number of layers of paperboard laminated together and typically ranges from 0.120 inch to approximately 0.400 inch. It is further known to place spaced dots of a special adhesive which allows the user to stick the corner post in place. The corner post thus grips the corners of the load until the stretch wrap or strap is applied. In this application, however, because the corner posts are shipped in stacks to conserve space, it is necessary that a release paper cover the adhesive faces of the corner posts to prevent the sticking together of adjacent corner posts in a stack.

SUMMARY OF THE INVENTION

The present invention in a presently preferred form provides an improved elongated corner post which is formed of multiple layers of laminated paperboard formed into a rigid right angle with a hard, dense paperboard spine at the apex where the strap bends around the angle. The corner post of the present invention includes a right angle paperboard member formed into an elongated rigid right angle having a pair of right angle legs joined at an apex. The right angle paperboard member has an inside surface and an outside surface. A right angle paperboard spine is secured to the outside surface of the paperboard member at its apex. In a presently preferred embodiment of the invention, the spine is formed of four-inch wide paperboard which is laminated to itself, folded over inwardly on itself, and adhered to itself by hot melt or other adhesive. The spine engages the right angle paperboard member at its apex, and the adhesive, such as hot melt or other suitable adhesive, extends along the length of the spine at its inside surface between the inner apex of the angle of the spine and the outer apex of the angle of the paperboard member. The width of the right angle legs of the spine is substantially less than the width of the right angle legs of the paperboard member thus providing a lateral offset between the respective outside surfaces thereof and a distinct step therebetween.

Included among the advantages of the present invention are that it provides a relatively thin paperboard angle with a hard, dense spine at the apex which puts the greatest thickness of paperboard where it is needed most for use with packaging straps. The spine is economically produced from four-inch wide paper available directly as trim from cylinder board paper machines. The lateral offset between the outside surface of the spine and the outside surface of the right angle paperboard member permits a pressure-sensitive or other adhesive to be placed on the inside surface of the paperboard member and then that member to be stacked with like corner posts. The offset prevents the adhesive from sticking the corner posts together eliminating the need for a release paper covering the adhesive. Further, it has been found that this offset permits the angles to slide more easily out of a magazine of stacked angles allowing easier automatic pick up and placement of the angles in a packaging operation.

DETAILED DESCRIPTION OF THE INVENTION

Figure 1:
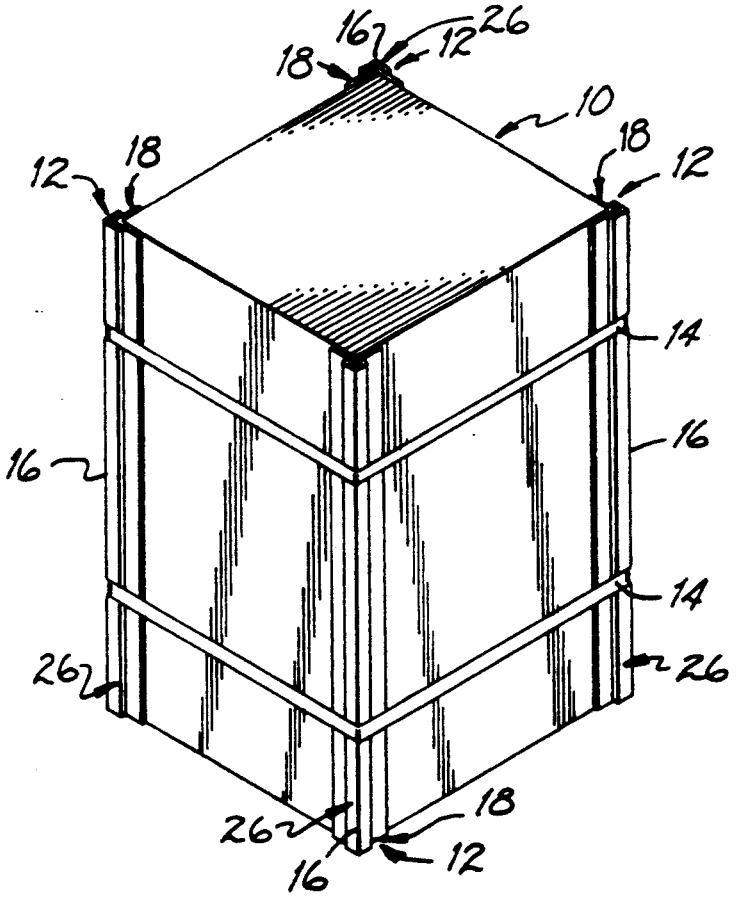
FIG. 1 is a perspective view showing one application of the corner post of the present invention.

Referring first to FIG. 1, one environment of the present invention is illustrated. In FIG. 1, an article 10 is shipped with corner posts 12 at its four vertical edges being retained thereby by upper and lower bands or straps 14 surrounding the corner posts 12 and article 10. The bands or straps 14 are typically made of steel or a high strength plastic and are tensioned to tightly secure the load. The rounded outer apex 16 of each corner post 12 provides for tightening of the straps 14 including preventing their substantial biting into the edges of the article 10. The corner post 12 provide protection to the edges of the article 10 and the rigid right angles provide the corner posts 12 with stacking strength.

Figure 2:
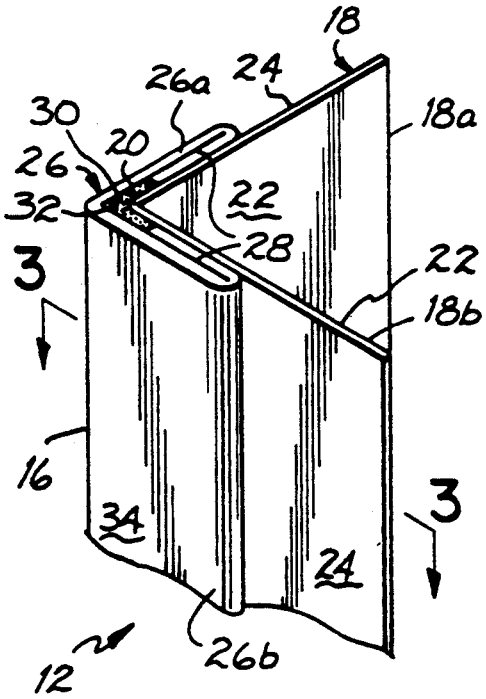
FIG. 2 is a perspective view of a presently preferred embodiment of the corner post of the present invention.
Figure 3:
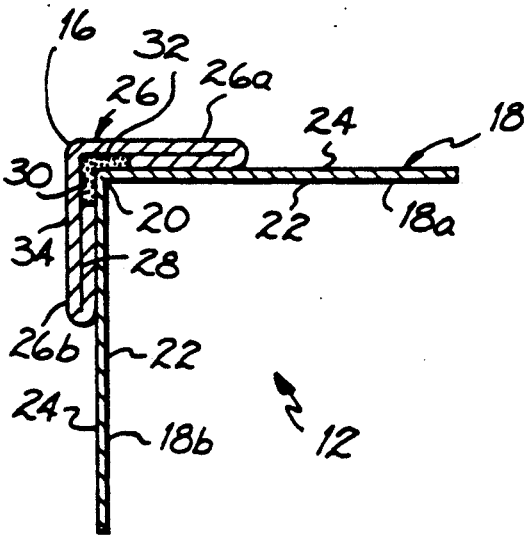
FIG. 3 is a cross-sectional view taken along line 3—3 of FIG. 1.

Referring now to FIGS. 2 and 3, the corner post 12 of the present invention includes a right angle paperboard member 18 formed of paperboard or of laminated sheets of paperboard into a rigid right angle. The right angle paperboard member 18 includes a pair of right angle legs 18*a*, 18*b* joined at an apex 20 such that the member has an inside surface 22 and an outside surface 24. Typically, the right angle member 18 comprises paperboard or sheets of paperboard laminated together to provide a thickness in the range of from about 0.009 to 0.150 inch.

The corner post 12 further includes a right angle paperboard spine 26 which is secured to the paperboard member 18 at its outside surface 24 along its apex 20. Referring in particular to FIG. 3, in a presently preferred form embodiment of the invention, the spine 26 is formed of sheets of paperboard which are formed with right angle legs 26*a*, 26*b* laminated together and then folded inwardly at their ends and joined by a hot melt or other suitable adhesive at the adjoining faces 28. In turn, the spine 26 is laminated to the outside surface of the right angle paperboard member 18 at the apex 20. Still further, the hot melt adhesive 30 is present in the void 32 between the outside surface 24 of the right angle paperboard member 18 at its apex 20 and the inside surface of the spine 26. That is, by virtue of the legs 26*a*, 26*b* of the spine 26 being folded inwardly, a void 32 is formed for receipt of the adhesive 30. The spine, in one embodiment of the invention, is formed of laminated sheets of paperboard to a thickness of about 0.060 inch providing, when folded upon itself as shown, a total thickness of 0.120 inch. Thus, the lateral offset provides a void 32 having a thickness of 0.060 inch for receipt of adhesive 30.

For purposes of economy, the spine may be formed of four-inch wide strips of paper which generally is the narrowest paper roll available off of a cylinder board paper machine. Thus, in a typical embodiment, each leg 26*a*, 26*b* of the spine 26 may be on the order of 1 inch in width whereas the width of the legs 18*a*, 18*b* of the right angle paperboard member 18 may be typically on the order of 2 to 4 inches. Thus, there is provided a distinct offset between the outside surface 34 of the spine 26 and the outside surface 24 of the paperboard member 18, for example, on the order of 0.120 inch in the embodiment described. Thus, when the corner posts 12 are placed in a stack for shipping or for loading into the magazine of a packaging machine, they more easily separate from one another. Thus, for example, a packaging machine may utilize an automatic mechanical pick up such as clamps instead of the more complicated suction cups to grab and place the corner posts in position for packaging.

One of the end results of the present invention is that the corner post 12 may be formed from just two webs of paper off of two rolls, although the paper on each roll may be themselves laminated.

Figure 4:
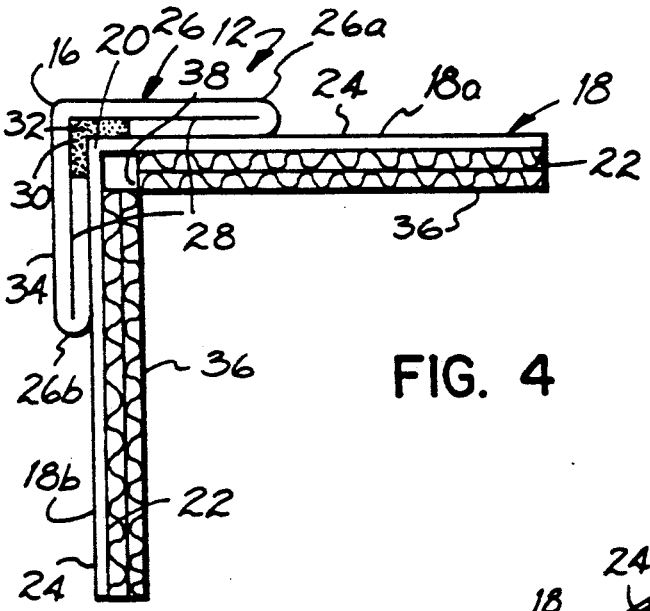
FIG. 4 is a end view of an alternative embodiment of the invention.

In the embodiment shown in FIG. 4, the corner post 12 of FIGS. 2 and 3 is provided with additional thickness and cushioning by a piece of double wall corrugated 36, which has been scored at 38, bent into a right angle, and glued to the inside surface 22 of the right angle paperboard member 18. The double wall corrugated 36 can be likewise secured to the legs of the paperboard member by a suitable adhesive.

Figure 5:
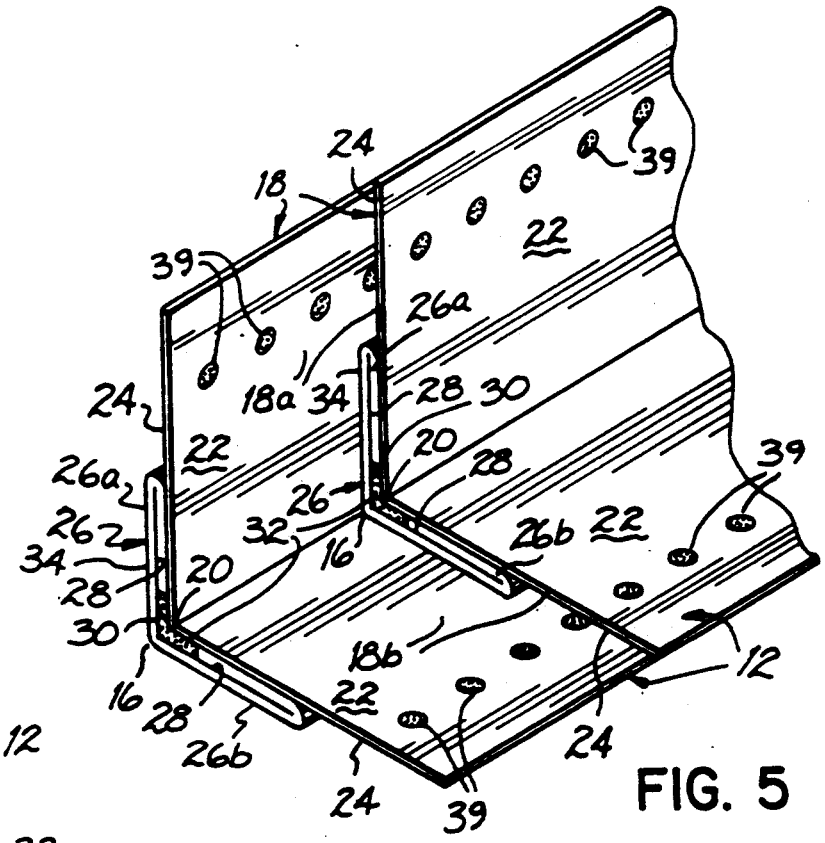
FIG. 5 is a schematic perspective view of a pair of corner posts having an adhesive spaced along the inner surfaces of the right angle legs.
Figure 6:
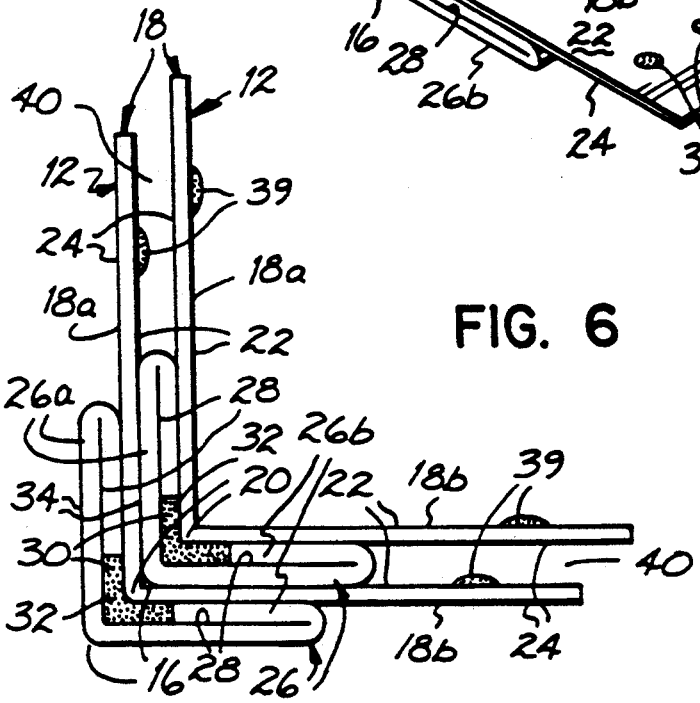
FIG. 6 is an end view of the pair of corner posts shown in FIG. 5 as they would appear in a stacked array of corner posts illustrating the offset between the right angled legs to accommodate the adhesive.

Referring now to FIG. 5, in the embodiment shown, spaced dots of a suitable pressure-sensitive adhesive 39 are applied to the inside surface 22 of the legs 18*a*, 18*b* of the paperboard member 18. This permits the corner post to be applied, for example, to a vertical angle of a product and stick in place until a strap or stretch wrap is applied. As shown in FIG. 6, when the corner posts 12 are stacked together, the lateral offset between the outside surface 34 of the spine 26 and the outside surface 24 of the paperboard member 18 provides a cavity 40 between the inside surface 22 of the paperboard member bearing the adhesive 39 and the outside surface 24 of the paperboard member 18 of an adjacent corner post 12. Thus, the adhesive 39 may be placed on the corner post 12 without its contacting an adjacent corner post 12 with any sufficient degree to cause adherence thereto. Thus, multiple corner posts 12 may be stacked together in an array each bearing adhesive 39 on the inner surface 22 of the legs 18*a*, 18*b* thereof without the need for release paper to prevent adherence of adjacent surfaces.

One of the particular advantages of the present invention is that it provides for the use of lighter weight angles 18 on the order of 0.009 to 0.080 inch in thickness useful for stretch wrap applications. Normally, an angle of such light weight would not maintain its right angle integrity. However, in the combination of the present invention with the spine 26 such lightweight angles do maintain integrity.

Further, the present invention which permits the manufacture of formed angles out of two paper rolls reduces the length of the angle machine over conventional angle machines.

Thus having described the invention, what is claimed is:

1. An integral, elongated corner post for cushioning and protecting an edge of an article comprising, in combination:

a paperboard member formed into an elongated rigid right angle and having a pair of legs joined at an apex, said member having an inside surface and an outside surface, a paperboard spine formed into an elongated rigid right angle and secured to the outside surface of said paperboard member at said apex, said spine comprising a pair of legs and having an inside surface and an outside surface, said legs of said spine being folded inwardly upon and laminated to themselves to define a portion of increased thickness, the inside surface of said portion of increased thickness being laminated to the outside surface of said paperboard member, the remainder of the inside surface of said spine being laterally offset from the outside surface of said paperboard member defining a void therebetween, and an adhesive within the void at said apex of said paperboard member.

2. The corner post of claim 1 wherein said spine is formed from laminated sheets of paper from an about 4-inch wide roll and wherein about 1 inch of each leg is folded inwardly.

3. The corner post of claim 1 wherein said legs of said paperboard member are about 0.009 to 0.150 inch in thickness.

4. The corner post of claim 1 wherein said legs of said paperboard member are about 0.009 to 0.150 inch in thickness and said portion of increased thickness of said spine is about 0.120 inch in thickness.

5. The corner post of claim 1 wherein said adhesive is a hot melt adhesive.

6. A stacked array of integral, elongated corner posts for cushioning and protecting the edges of articles comprising, in combination:

a plurality of paperboard members, each formed into an elongated rigid right angle and having a pair of legs joined at an apex, each said member having an inside surface and an outside surface, a paperboard spine formed into an elongated rigid right angle and secured to the outside surface of each said paperboard member at said apex, said spine comprising a pair of legs and having an inside surface and an outside surface, said legs of said spine being folded inwardly upon and laminated to themselves to define a portion of increased thickness, the inside surface of said portion of increased thickness of said spine being laminated to the outside surface of said paperboard member, the remainder of the inside surface of said spine being laterally offset from the outside surface of said paperboard member defining a void therebetween, an adhesive within the void at the apex of said paperboard member, each said paperboard member having a contact adhesive on the inside surface of their respective legs, outboard of the legs of said spine, each said spine spacing the legs of adjacent paperboard members one from another to prevent contact of the adhesive on one paperboard member from an adjacent paperboard member in said stacked array.

* * * * *